US009774109B2

(12) United States Patent
Tabata et al.

(10) Patent No.: US 9,774,109 B2
(45) Date of Patent: Sep. 26, 2017

(54) TERMINAL FITTING

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Masaaki Tabata, Mie (JP); Yasuo Oomori, Mie (JP); Hajime Matsui, Mie (JP); Hideaki Itou, Mie (JP); Kenta Ito, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/109,834

(22) PCT Filed: Jan. 13, 2015

(86) PCT No.: PCT/JP2015/050592

§ 371 (c)(1),
(2) Date: Jul. 6, 2016

(87) PCT Pub. No.: WO2015/115160

PCT Pub. Date: Aug. 6, 2015

(65) Prior Publication Data

US 2016/0329644 A1 Nov. 10, 2016

(30) Foreign Application Priority Data

Jan. 31, 2014 (JP) ..... 2014-017417

(51) Int. Cl.
*H01R 13/648* (2006.01)
*H01R 11/12* (2006.01)
(Continued)

(52) U.S. Cl.
CPC ..... *H01R 11/12* (2013.01); *H01R 4/64* (2013.01); *H01R 4/66* (2013.01); *H01R 11/05* (2013.01); *H01R 11/32* (2013.01)

(58) Field of Classification Search
CPC . H01R 11/12; H01R 4/64; H01R 4/66; H01R 11/05; H01R 11/32
(Continued)

(56) References Cited

U.S. PATENT DOCUMENTS 6,086,399 A 7/2000 Matsunaga et al.
2011/0269323 A1* 11/2011 Omori ..... H01R 13/648 439/108
(Continued)

FOREIGN PATENT DOCUMENTS

JP 10-208815 8/1998
JP 2004-253167 9/2004
(Continued)

OTHER PUBLICATIONS

International Search Report.

*Primary Examiner* — Abdullah Riyami
*Assistant Examiner* — Nader Alhawamdeh
(74) *Attorney, Agent, or Firm* — Gerald E. Hespos; Michael J. Porco; Matthew T. Hespos

(57) ABSTRACT

A grounding terminal unit (A) is sandwiched between a seating surface (S) of a bolt (B) and a grounding part (E) with first connecting plates (13) of a first grounding terminal fitting (10) and second connecting plates (43) of a second grounding terminal fitting (40) placed one over the other in a plate thickness direction. The first grounding terminal fitting (10) is configured by uniting two divided fittings (20, 30) including tabs (19) connectable to first conductive paths (Wa) and the two divided fittings (20, 30) are formed with uniting locking portions (25, 33) for holding the two divided
(Continued)

fittings (20, 30) in a united state by being locked to each other at a position different from the first connecting plates (13). The first connecting plates (13) are in the form of single plates with the two divided fittings (20, 30) united.

7 Claims, 12 Drawing Sheets

(51) Int. Cl.
*H01R 4/64* (2006.01)
*H01R 11/05* (2006.01)
*H01R 11/32* (2006.01)
*H01R 4/66* (2006.01)

(58) Field of Classification Search
USPC ..... 439/92
See application file for complete search history.

(56) References Cited

U.S. PATENT DOCUMENTS

| | | | | |
|---|---|---|---|---|
| 2011/0294317 | A1* | 12/2011 | Nishio | H01R 4/305 439/95 |
| 2013/0267105 | A1 | 10/2013 | Horiuchi | |
| 2014/0220792 | A1 | 8/2014 | Omori et al. | |
| 2014/0235078 | A1* | 8/2014 | Omori | H01R 4/64 439/98 |
| 2014/0377975 | A1 | 12/2014 | Omori et al. | |

FOREIGN PATENT DOCUMENTS

| | | |
|---|---|---|
| JP | 2011-60522 | 3/2011 |
| JP | 2011-249181 | 12/2011 |
| JP | 2013-65502 | 4/2013 |
| JP | 2013-80688 | 5/2013 |
| JP | 2013-134846 | 7/2013 |
| JP | 2013-257975 | 12/2013 |

* cited by examiner

TERMINAL FITTING

BACKGROUND

1. Field of the Invention

The present invention relates to a grounding terminal unit.

2. Description of the Related Art

Japanese Unexamined Patent Publication No. H10-208815 discloses a grounding terminal unit configured by combining two grounding terminal fittings. Each of the two grounding terminal fittings constituting the grounding terminal unit is formed by applying bending and the like to a metal plate member having a predetermined shape. More particularly, each grounding terminal fitting includes a conductive path connecting portion to which a grounding conductive path, such as a wire, is connected and a substantially plate-like grounding connecting portion. The grounding connecting portion is formed with a through hole penetrating in its plate thickness direction and a locking portion. The two grounding terminal fittings are assembled with the grounding connecting portions placed one over the other in the plate thickness direction and held in an assembled state by the locking action of the locking portions. The through holes of the two grounding connecting portions are arranged concentrically in this state. Thus, the grounding terminal unit can be connected to a grounding part if a bolt is inserted into the through holes and screwed and tightened into the grounding part.

The grounding terminal unit that can be held in the assembled state by placing the two grounding connecting portions one over the other in the plate thickness direction in this way is handled easily when being carried into a site of a connecting operation to the grounding part as compared to the case where two grounding terminal fittings cannot be held in the assembled state. Further, with the grounding terminal unit bolted, the two grounding connecting portions placed one over the other are sandwiched between a seating surface of the bolt and the grounding part. Thus, if the number of the grounding terminal fittings to be assembled is limited to two, a thickness of the two grounding connecting portions placed one over the other is fixed and a length of the bolt used also is fixed. Therefore, there is an advantage that only one type of bolt is required.

However, it is structurally impossible for the above grounding terminal unit to place three or more grounding terminal fittings one above another in the plate thickness direction with the length of the bolt kept constant. Thus, it is difficult to drastically increase the number of grounding conductive paths of the grounding terminal unit as a whole and to increase the number of types of grounding conductive paths connectable to the grounding terminal unit under a condition that only one type of bolt is used.

The present invention was completed based on the above situation and aims to increase the number of connectable grounding conductive paths and the number of types thereof without increasing the number of types of fastening members used in a grounding terminal unit to be connected to a grounding part by screwing a fastening member.

SUMMARY

The present invention is directed to a grounding terminal unit with first and second grounding terminal fittings. The first grounding terminal fitting is formed with a first bolt insertion hole, a first connecting plate arranged on an opening edge of the first bolt insertion hole and a first assembling locking portion. The second grounding terminal fitting is formed with a second bolt insertion hole, a second connecting plate arranged on an opening edge of the second bolt insertion hole and a second assembling locking portion. The first and second connecting plates are held in an assembled state where the first and second connecting plates are placed one over the other in a plate thickness direction by locking the first and second assembling locking portions. A bolt, constituting a fastening member, is penetrated through the first and second bolt insertion holes and connected to the grounding part with the first and second connecting plates sandwiched between a seating surface of the fastening member and the grounding part. The first grounding terminal fitting is configured by uniting two divided fittings including conductive path connecting portions connectable to grounding conductive paths. The two divided fittings are formed with uniting locking portions for holding the two divided fittings in a united state by being locked to each other at a position different from the first connecting plate. The first connecting plate is in the form of a single plate in a state where the two divided fittings are united.

The first grounding terminal fitting is configured by uniting the two divided fittings including the conductive path connecting portions connectable to the grounding conductive paths. Thus, the number of the connectable grounding conductive paths and the number of types thereof can be increased as compared to the case where the first grounding terminal unit is composed of a single component. Further, the uniting locking portions arranged at the position different from the first connecting plate do not interfere with the seating surface of the fastening member and the grounding part. By arranging the uniting locking portions at the position different from the first connecting plate, the first connecting plate is in the form of a single plate. Thus, it is not necessary to change a thickness of the first connecting plate. Therefore, even if the number of constituent components of the first grounding terminal fitting is increased to two, an interval between the grounding part and the seating surface of the fastening member need not be changed. As just described, according to the present invention, the number of the connectable grounding conductive paths and the number of types thereof can be increased without increasing the number of types of fastening members used.

The two divided fittings may be formed with the first connecting plate. According to this configuration, the two divided fittings are sandwiched reliably between the seating surface of the fastening member and the grounding part at the first connecting plate. Therefore connection reliability to the grounding part is high.

One of the two divided fittings may be formed with a frame continuously surrounding the first bolt insertion hole over the entire circumference and an inner peripheral edge of the frame may define at least a part of the first connecting plate. According to this configuration, the strength of the first connecting plate is enhanced by the frame.

The divided fitting may be formed so that the conductive path connecting portion extends from a plate. The plates may be arranged in a width direction with the two divided fittings united to configure the first grounding terminal fitting including the first connecting plate. The second grounding terminal fitting may be formed so that the conductive path connecting portion extends from a second grounding connecting portion including the second connecting plate. The first and second grounding connecting portions are assembled to be arranged in the width direction, and the conductive path connecting portion of the first grounding terminal fitting and that of the second grounding terminal fitting may extend in a direction intersecting the width direction. According to this configuration, all of the conductive path connecting portions formed on the first and second grounding terminal fittings are arranged within a range taken up by the first and second grounding connecting portions in the width direction.

The two divided fittings may be formed with a plate as the first grounding connecting portion, and arms may extend substantially at a right angle from the first grounding connecting plate. A plurality of supporting plates may extend substantially at a right angle from extending ends of the arms. The conductive path connecting portions may be long, narrow and parallel to one another, and may be cantilevered from extending end edges of the plurality of supporting plates. A harness connecting portion may be connected to a plurality of the grounding conductive paths. The harness connecting portion may comprise the arms, the supporting plates and the conductive path connecting portions and may be connectable to the plurality of grounding conductive paths.

At least one of the two divided fittings may be formed with a plurality of the conductive path connecting portions. Thus, the number of the connectable grounding conductive paths can be increased.

The conductive path connecting portions may be crimping portions in the form of open barrels. Accordingly, the grounding conductive paths can be connected reliably by the crimping portions.

The conductive path connecting portion of the first grounding terminal fitting and that of the second grounding terminal fitting may have mutually different connection forms. Thus, grounding conductive paths having different connection forms can be connected.

DETAILED DESCRIPTION

Hereinafter, a first specific embodiment of the present invention is described with reference to FIGS. 1 to 10. A grounding terminal unit A of this embodiment is formed by placing a first grounding terminal fitting 10, to which a plurality of first conductive paths Wa (grounding conductive paths as claimed) are to be connected, and a second grounding terminal fitting 40, to which one second conductive path Wb (grounding conductive path as claimed) is to be connected, one over the other, and these two grounding terminal fittings 10, 40 are connected to a grounding part E by one bolt B. The first grounding terminal fitting 10 of this embodiment is characterized by enabling the use of the bolt B having the same length (type) as the one for a grounding terminal fitting composed of a single component while being configured by uniting two divided fittings 20, 30.

Figure 2:
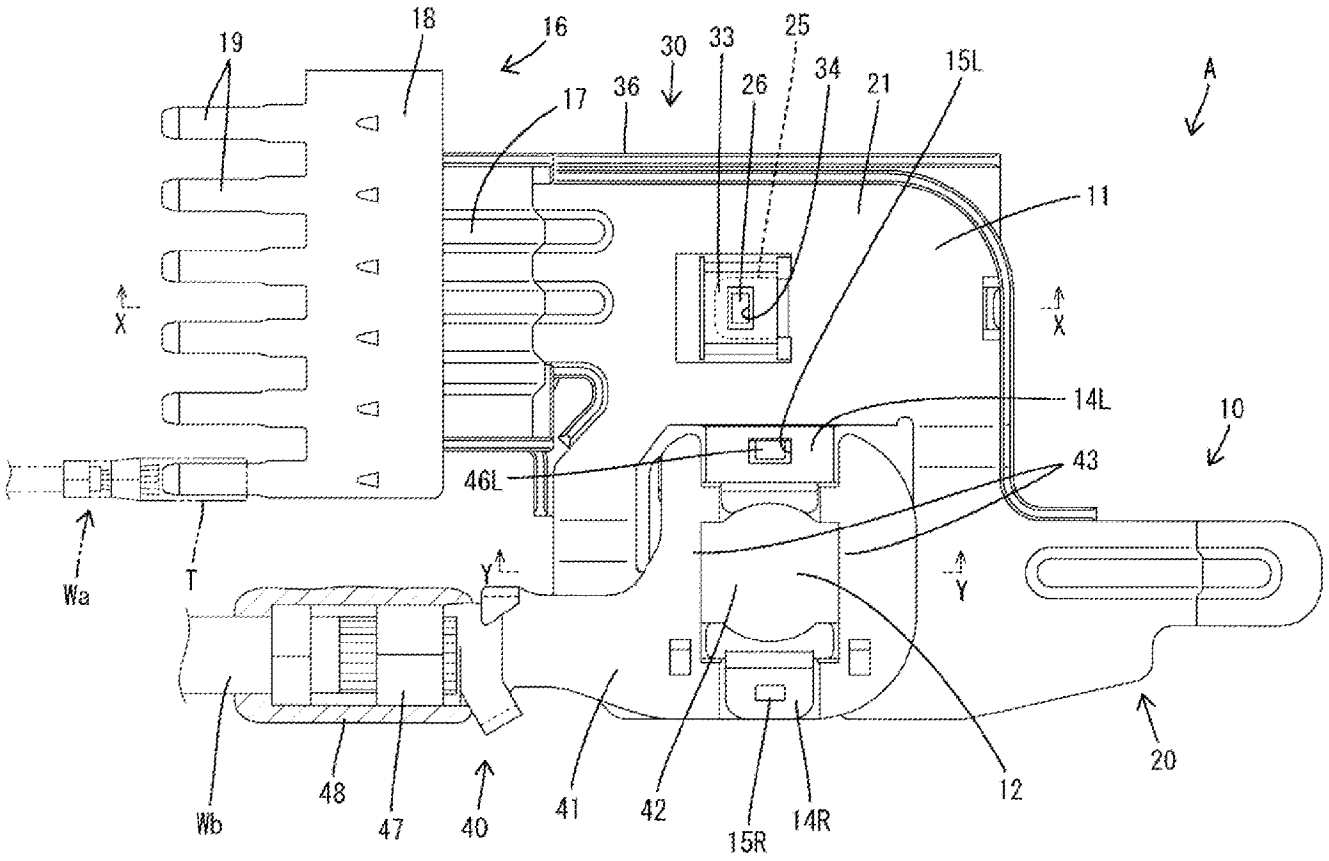
FIG. 2 is a plan view of the grounding terminal unit.
Figure 3:
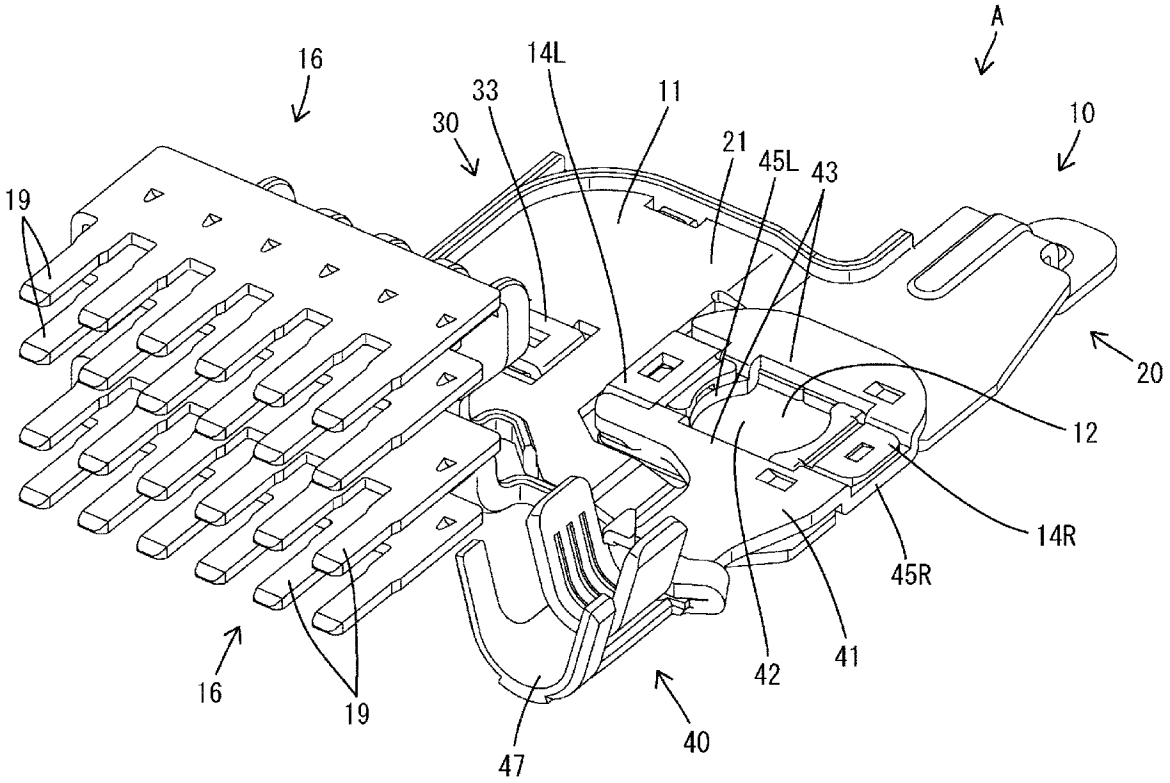
FIG. 3 is a perspective view of the grounding terminal unit.

Note that a vertical direction in the following description is based on a state where the grounding terminal unit A is connected to the horizontal grounding part E (grounding surface) (see FIG. 10) for the sake of convenience. Further, a plate thickness direction of each component constituting the grounding terminal unit A is used as a synonym for the vertical direction. Further, a right side in FIG. 2 is defined as a front side concerning a front-back direction. An upper side in FIG. 2 is defined as a left side concerning a lateral direction.

<First Grounding Terminal Fitting 10>

As shown in FIGS. 2, 3, 4 and 8, the first grounding terminal fitting 10 is configured by uniting the first divided fitting 20 (see FIG. 5) and the second divided fitting 30 (see FIG. 7) as a component separate from the first divided fitting 20. A united state of the two divided fittings 20, 30 is described. The first grounding terminal fitting 10 includes a first grounding connecting portion 11 substantially in the form of a flat plate and a harness connecting portion 16 AT the rear end of the first grounding connecting portion 11.

Figure 4:
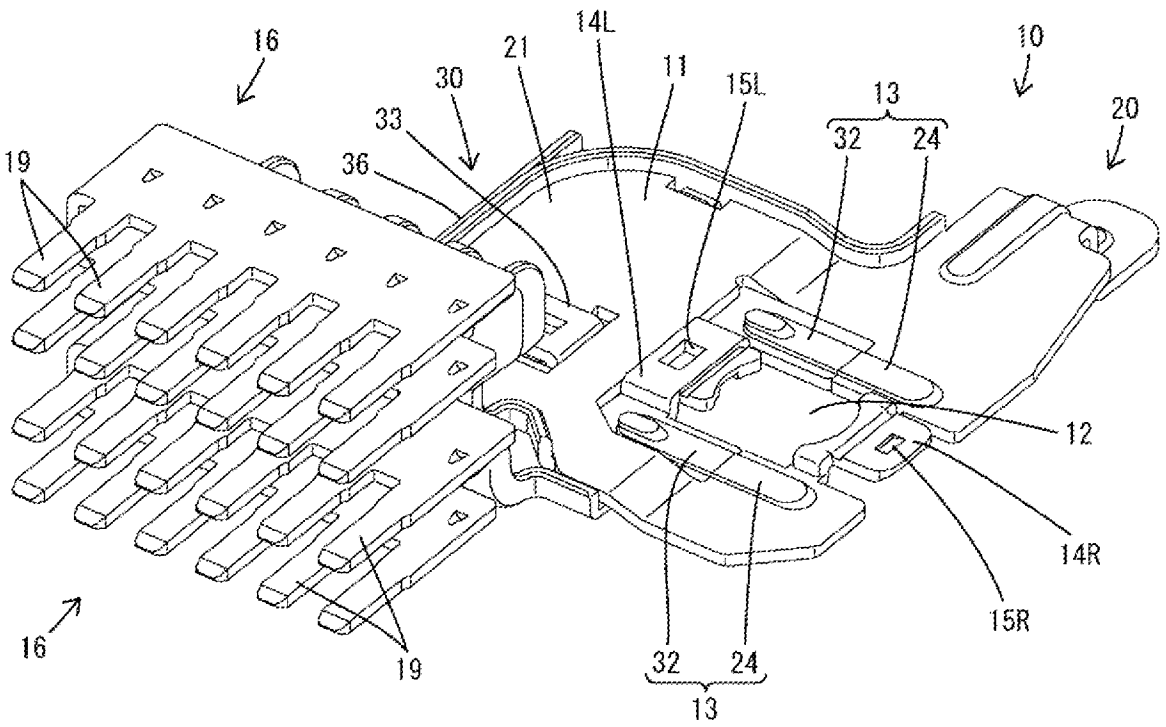
FIG. 4 is a perspective view of a first grounding terminal fitting.

As shown in FIG. 4, the first grounding connecting portion 11 is formed with a first bolt insertion hole 12 penetrating in the vertical direction (plate thickness direction). Front and rear edge sides of an opening edge part of the first bolt insertion hole 12 serve as a pair of front and rear first plate-like connecting portions 13 extending in the lateral direction. Left end parts of the upper surfaces of the both front and rear first plate-like connecting portions 13 are struck to project slightly upwardly, thereby forming first contact portions 14.

Left and right edge sides of the opening edge part of the first bolt insertion hole 12 serve as left and right first assembling locking portions 14L, 14R. These left and right first assembling locking portions 14L, 14R project upwardly (toward a top surface side) in a step-like manner with respect to the first plate-like connecting portions 13. A height difference between these first assembling locking portions 14L, 14R and the first plate-like connecting portions 13 is a dimension slightly smaller than plate thicknesses of the first plate-like connecting portions 13 and the first assembling locking portions 14L, 14R. The left first assembling locking portion 14L is formed with a first assembling locking hole 15L penetrating in the vertical direction. The right first assembling locking portion 14R is formed with a first assembling locking projection 15R projecting obliquely downwardly to the left by cutting and bending.

The harness connecting portion 16 is composed of a plurality of arm portions 17, four plate-like supporting portions 18 and a plurality of long and narrow tabs 19 (conductive path connecting portions as claimed). The plurality of arm portions 17 extend from the rear end edge of the first grounding connecting portion 11 to stand up substantially at a right angle while being laterally arranged in parallel. The four plate-like supporting portions 18 extend backward substantially at a right angle from the upper ends of the plurality of arm portions 17 and are substantially parallel to the first grounding connecting portion 11. Each tab 19 extends backward in a cantilever manner from the rear end edge of each plate-like supporting portion 18.

The tabs 19 are flush with the plate-like supporting portions 18 and laterally arranged in parallel along the rear end edges (extending end edges) of the plate-like supporting portions 18. The four plate-like supporting portions 18 are arranged while being vertically spaced apart from each other. The upper two plate-like supporting portions 18 are coupled on the left end edges thereof and the lower two plate-like supporting portions 18 are coupled on the left end edges thereof. The plurality of tabs 19 are aligned and arranged in the vertical direction and the lateral direction.

Figure 1:
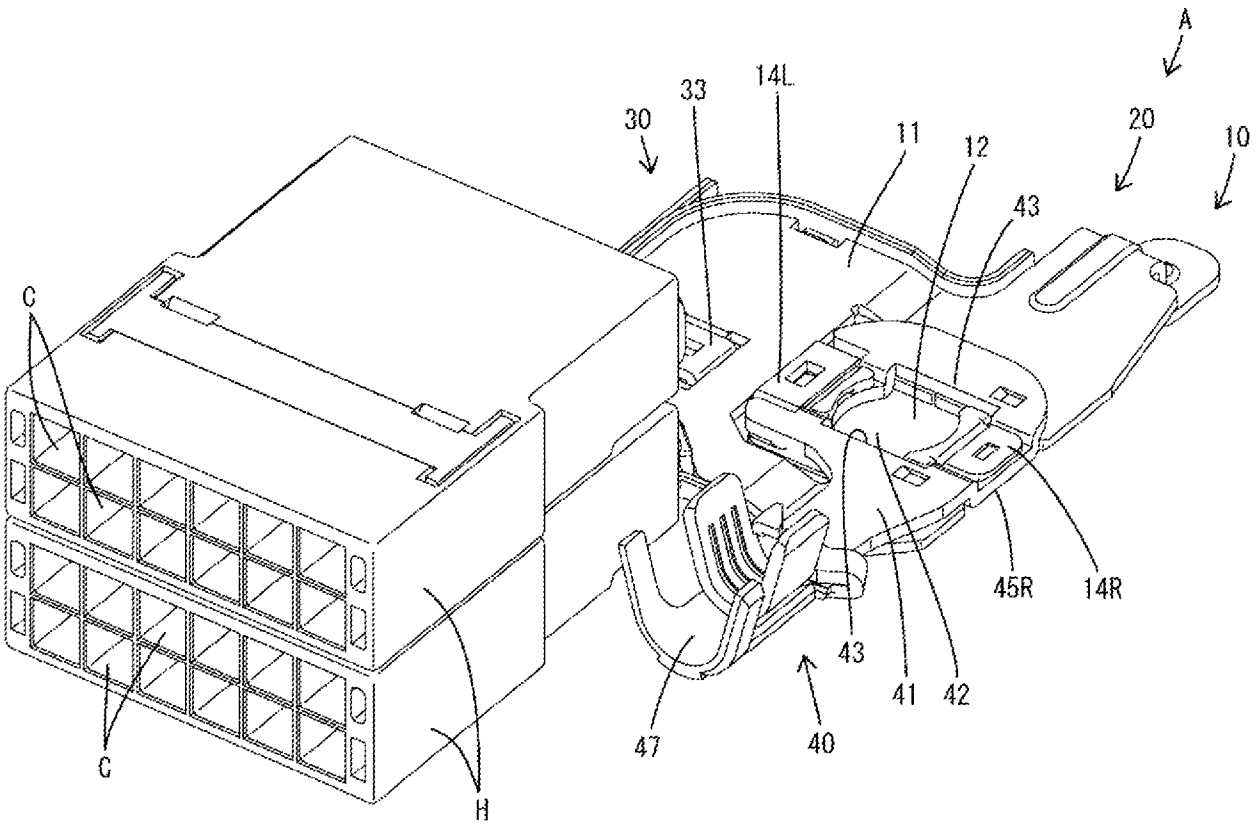
FIG. 1 is a perspective view showing a state where conductive path connecting portions of a grounding terminal unit of a first embodiment are mounted in a connector housing.

As shown in FIG. 1, out of the harness connecting portion 16, the upper two plate-like supporting portions 18 and the tabs 19 projecting from these plate-like supporting portions 18 are accommodated in a connector housing H in an upper stage. The lower two plate-like supporting portions 18 and the tabs 19 projecting from these plate-like supporting portions 18 are accommodated in a connector housing H in a lower stage. The connector housing H is formed with a plurality of cavities C open on the rear end surface, and the tab 19 is individually waiting on standby in each cavity C. Female terminal fittings T (see FIG. 2) on end parts of the plurality of first conductive paths Wa constituting a wiring harness (not shown) are inserted in the cavities C. The female terminal fittings T and the tabs 19 are connected in the cavities C.

<First Divided Fitting 20>

Figure 5:
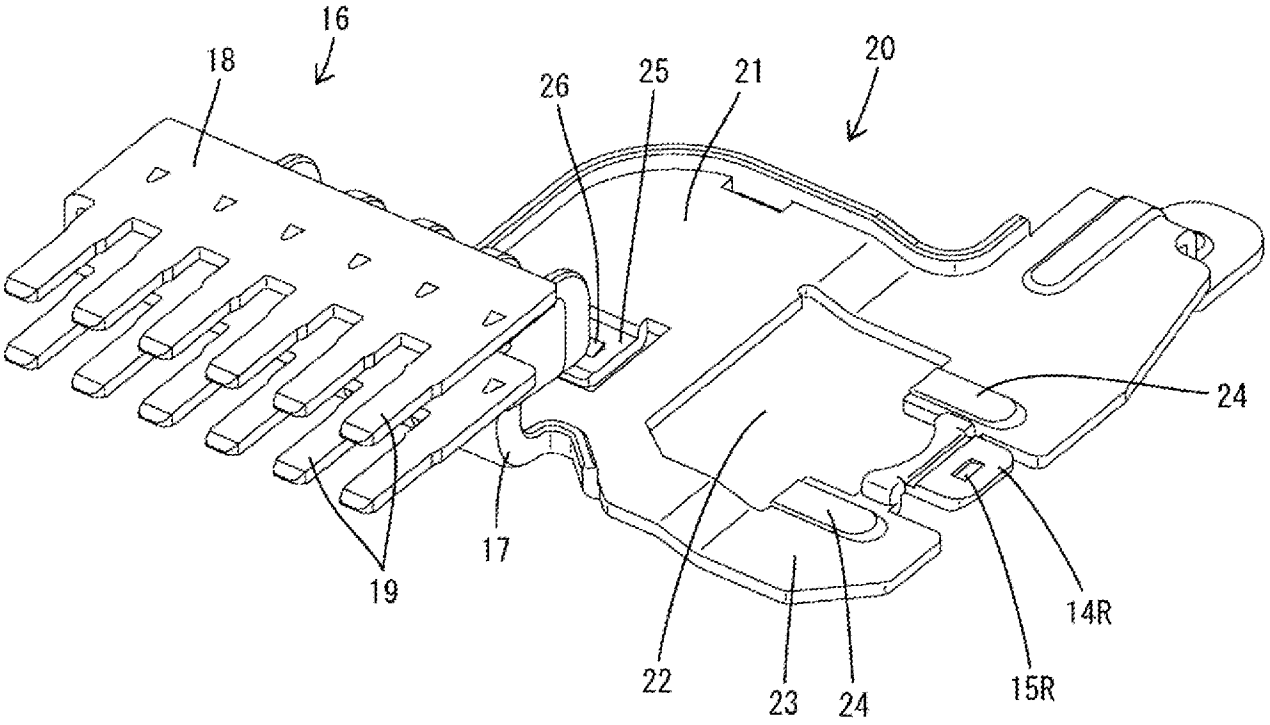
FIG. 5 is a perspective view of a first divided fitting.
Figure 6:
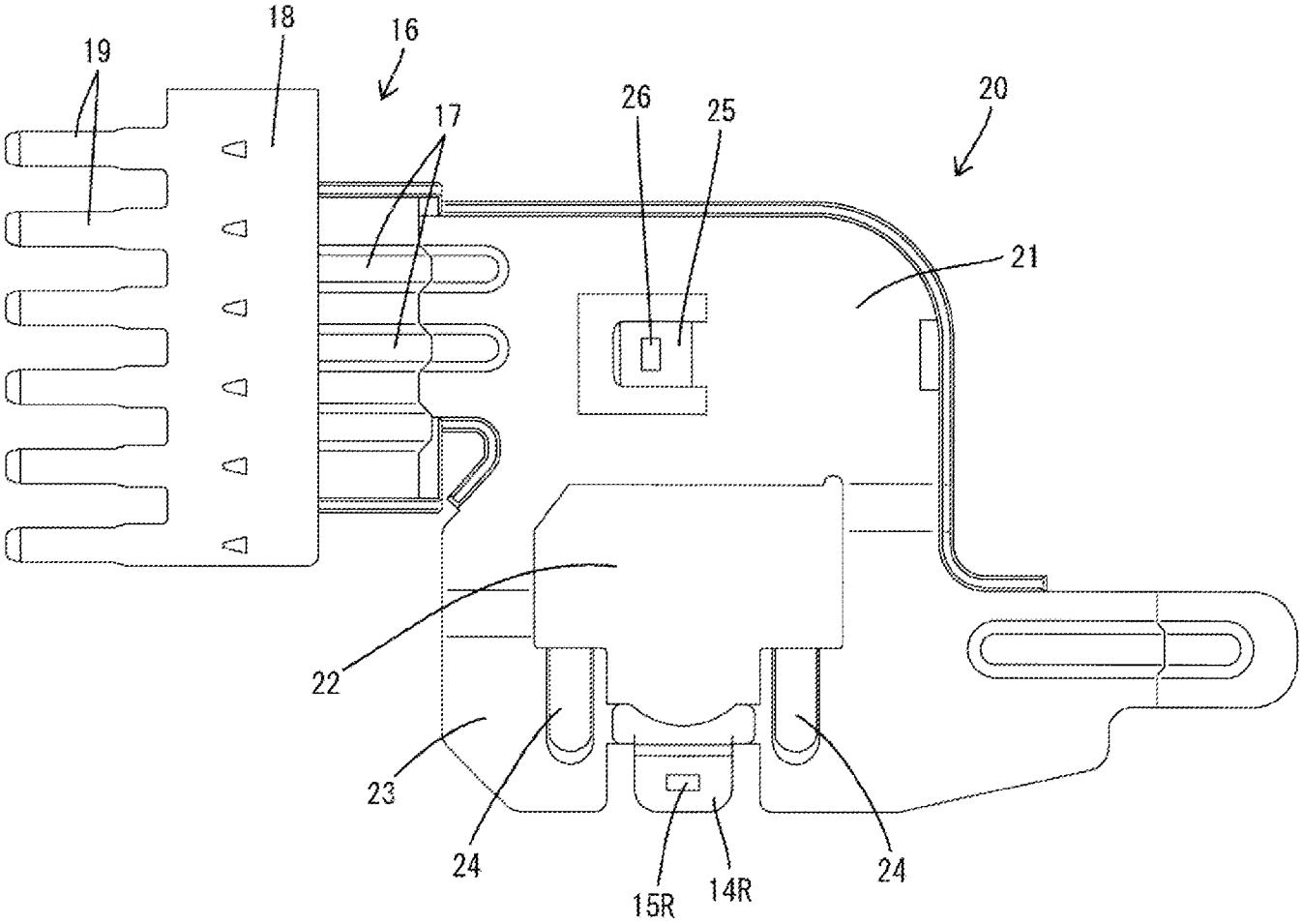
FIG. 6 is a plan view of the first divided fitting.

As shown in FIGS. 5 and 6, the first divided fitting 20 is an integral assembly of a first plate-like portion 21 (plate-like portion as claimed) constituting the first grounding connecting portion 11, upper two plate-like supporting portions 18 of the harness connecting portion 16, the plurality of arm portions 17 extending substantially a right angle from the rear end edge of the first plate-like portion 21 and supporting the upper two plate-like supporting portions 18 and the plurality of tabs 19 projecting from the upper two plate-like supporting portions 18.

The first plate-like portion 21 is formed with an opening 22 penetrating in the vertical direction. This opening 22 constitutes the first bolt insertion hole 12. The opening 22 is continuously surrounded over the entire circumference by a frame portion 23 constituting the first plate-like portion 21. Both front and rear edge parts of the opening edge of the opening 22 are formed with protruding portions 24 protruding into the opening 22 from right side areas of the front and rear edge parts. This pair of protruding portions 24 constitute the first plate-like connecting portions 13. These protruding portions 24 constitute the frame portion 23.

A right edge part of the opening edge of the opening 22 is formed with the right first assembling locking portion 14R described above. This right first assembling locking portion 14R is elevated from the first plate-like portion 21 in a step-like manner. A height difference between this right first assembling locking portion 14R and the first plate-like portion 21 is a dimension slightly smaller than a plate thickness of the first plate-like portion 21. This right first assembling locking portion 14R constitutes the frame portion 23 similarly to the protruding portions 24.

Further, the first plate-like portion 21 is formed with a first uniting locking portion 25 as a means for uniting the first and second divided fittings 20, 30. The first uniting locking portion 25 is arranged at a position of the first plate-like portion 21 to the left of the opening 22. The first uniting locking portion 25 is formed at this position different from the positions of the first plate-like connecting portions 13 (protruding portions 24) and not in contact with the bolt B as a fastening member. The first uniting locking portion 25 is formed by striking the first plate-like portion 21 such that the first plate-like portion 21 projects downwardly in a step-like manner. A height difference between the first uniting locking portion 25 and the first plate-like portion 21 is a dimension slightly smaller than the plate thickness of the first plate-like portion 21. A uniting locking projection 26 projecting obliquely upwardly to the front is formed on the upper surface of the first uniting locking portion 25 by cutting and bending.

<Second Divided Fitting 30>

Figure 7:
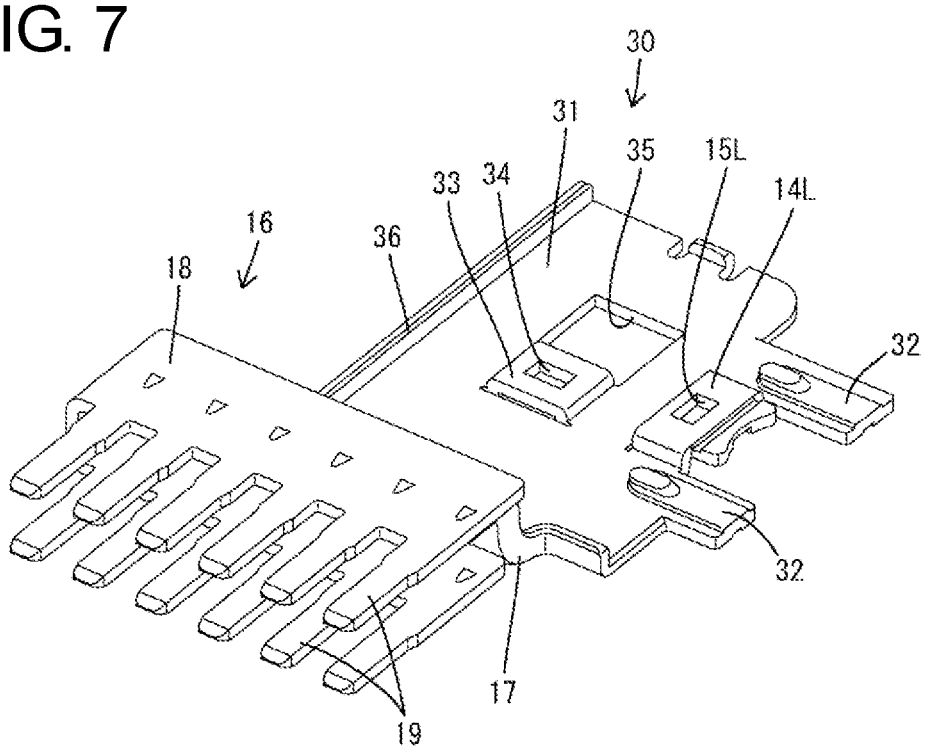
FIG. 7 is a perspective view of a second divided fitting.

As shown in FIG. 7, the second divided fitting 30 is an integral assembly of a second plate-like portion 31 (plate-like portion as claimed) constituting the first grounding connecting portion 11, the lower two plate-like supporting portions 18 of the harness connecting portion 16, the plurality of arm portions 17 extending substantially a right angle from the rear end edge of the second plate-like portion 31 and supporting the lower two plate-like supporting portions 18 and the plurality of tabs 19 projecting from the lower two plate-like supporting portions 18. A plate thickness of the second plate-like portion 31 is equal to that of the first plate-like portion 21.

A right edge part of the second plate-like portion 31 is formed with the left first assembling locking portion 14L described above. This left first assembling locking portion 14L is elevated from the second plate-like portion 31 in a step-like manner. A height difference between this left first assembling locking portion 14L and the second plate-like portion 31 is a dimension slightly smaller than the plate thickness of the second plate-like portion 31. The right edge part of the second plate-like portion 31 is formed with a pair of front and rear projecting portions 32 extending leftward in a cantilever manner. These front and rear projecting portions 32 constitute the first plate-like connecting portions 13 in cooperation with the protruding portions 24 of the first plate-like portion 21.

Further, the second plate-like portion 31 is formed with a second uniting locking portion 33 as a means for uniting the first and second divided fittings 20, 30. The second uniting locking portion 33 is arranged at a position of the second plate-like portion 31 to the left of the left first assembling locking portion 14L. The second uniting locking portion 33 is formed at this position different from the positions of the first plate-like connecting portions 13 (projecting portions 32) and not in contact with the bolt B as a fastening member. The second uniting locking portion 33 is formed by striking the second plate-like portion 31 such that the second plate-like portion 31 projects upwardly in a step-like manner. A height difference between the second uniting locking portion 33 and the second plate-like portion 31 is a dimension slightly smaller than the plate thickness of the second plate-like portion 31. The second uniting locking portion 33 is formed with a uniting locking hole 34 penetrating in the vertical direction. Further, the second plate-like portion 31 is formed with an escaping hole 35 penetrating through an area before and adjacent to the second uniting locking portion 33 in the vertical direction.

<United Form of First and Second Divided Fittings 20, 30>

The first and second divided fittings 20, 30 are united in advance before the first and second grounding terminal fittings 10, 40 are assembled. In uniting the both divided fittings 20, 30, the first plate-like portion 21 is placed on the upper surface of the second plate-like portion 31 and the first uniting locking portion 25 is inserted into the escaping hole 35. At this time, the right first assembling locking portion 14R is arranged at a position displaced forwardly from the left first assembling locking portion 14L and the pair of front and rear protruding portions 24 are arranged at positions displaced forwardly from the pair of front and rear projecting portions 32. Further, a part of the frame portion 23 is on the rear projecting portion 32. That is, the first divided fitting 20 is located at a position displaced forwardly from a proper united position with respect to the second divided fitting 30.

From this state, the first uniting locking portion 25 is caused to slip under the second uniting locking portion 33 while the first divided fitting 20 is slid backward (moved in parallel) relative to the second divided fitting 30. During this time, the left first assembling locking portion 14L formed on the second divided fitting 30 slides in contact with the left side of the opening edge of the opening 22 of the first divided fitting 20 and a rib 36 formed on the left edge of the second plate-like portion 31 of the second divided fitting 30 slides in contact with the left edge of the first plate-like portion 21 of the first divided fitting 20. By this sliding contact action on the left and right sides, the first and second divided fittings 20, 30 slide while keeping a stable positional relationship without relatively moving in the lateral direction.

When the first and second divided fittings 20, 30 reach a properly united state, the front projecting portion 32 comes into contact with the opening edge of the opening 22 from behind, thereby regulating a backward relative movement (slide) of the first divided fitting 20. Simultaneously, the uniting locking projection 26 is locked into the uniting locking hole 34, thereby regulating a forward returning movement of the first divided fitting 20 with respect to the second divided fitting 30. Further, the left first assembling locking portion 14L and the rib 36 come into contact with and sandwich the first plate-like portion 21 and the left ends of the protruding portions 24 and the right ends of the projecting portions 32 come into contact. By this contact action, relative movements of the first and second divided fittings 20, 30 in the lateral direction are regulated. Furthermore, the first plate-like portion 21 comes into contact with the upper surface of the second plate-like portion 31 and the first uniting locking portion 25 comes into contact with the lower surface of the second uniting locking portion 33, thereby regulating relative movements (separating movements) of the first and second divided fittings 20, 30 in the vertical direction. In the above way, the first and second divided fittings 20, 30 are held in the united state to configure the first grounding terminal fitting 10.

With the first and second divided fittings 20, 30 united, the front protruding portion 24 and the front projecting portion 32 are flush with each other and arranged adjacent to each other in the lateral direction, and the rear protruding portion 24 and the rear projecting portion 32 are flush with each other and arranged adjacent to each other in the lateral direction. The pair of front and rear first plate-like connecting portions 13 are configured by the pair of front and rear protruding portions 24 and the pair of front and rear projecting portions 32. Further, the right and left first assembling locking portions 14R, 14L are arranged at positions higher than the first plate-like portions 13. An area of the opening 22 of the first plate-like portion 21 surrounded by the pair of front and rear first plate-like connecting portion 13 and the pair of left and right first assembling locking portions 14L, 14R serves as the first bolt insertion hole 12.

<Second Grounding Terminal Fitting 40>

Figure 8:
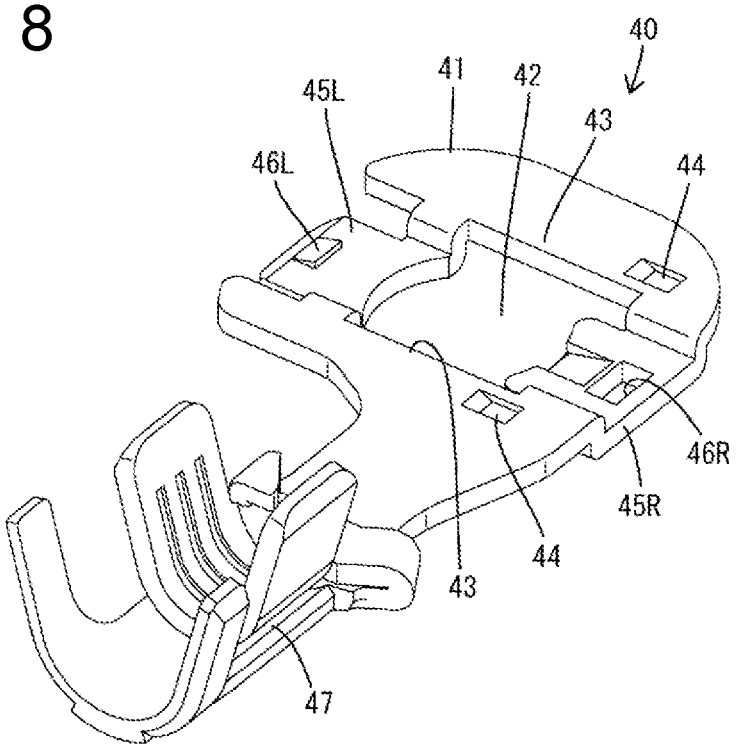
FIG. 8 is a perspective view of a second grounding terminal fitting.
Figure 9:
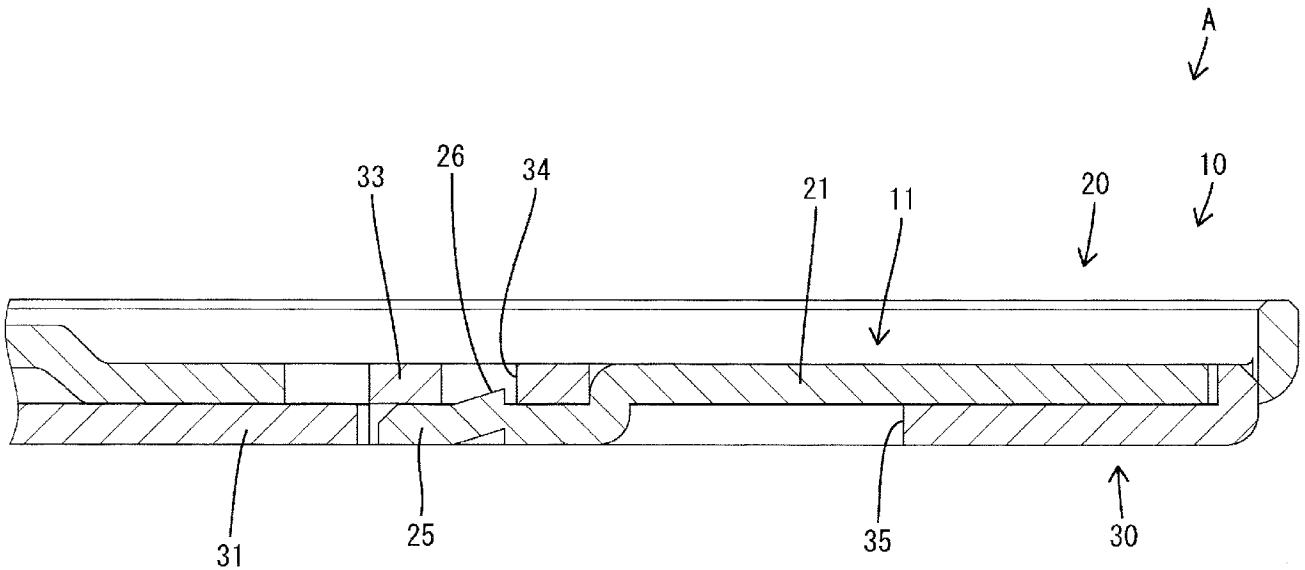
FIG. 9 is a section along X-X of FIG. 2.
Figure 10:
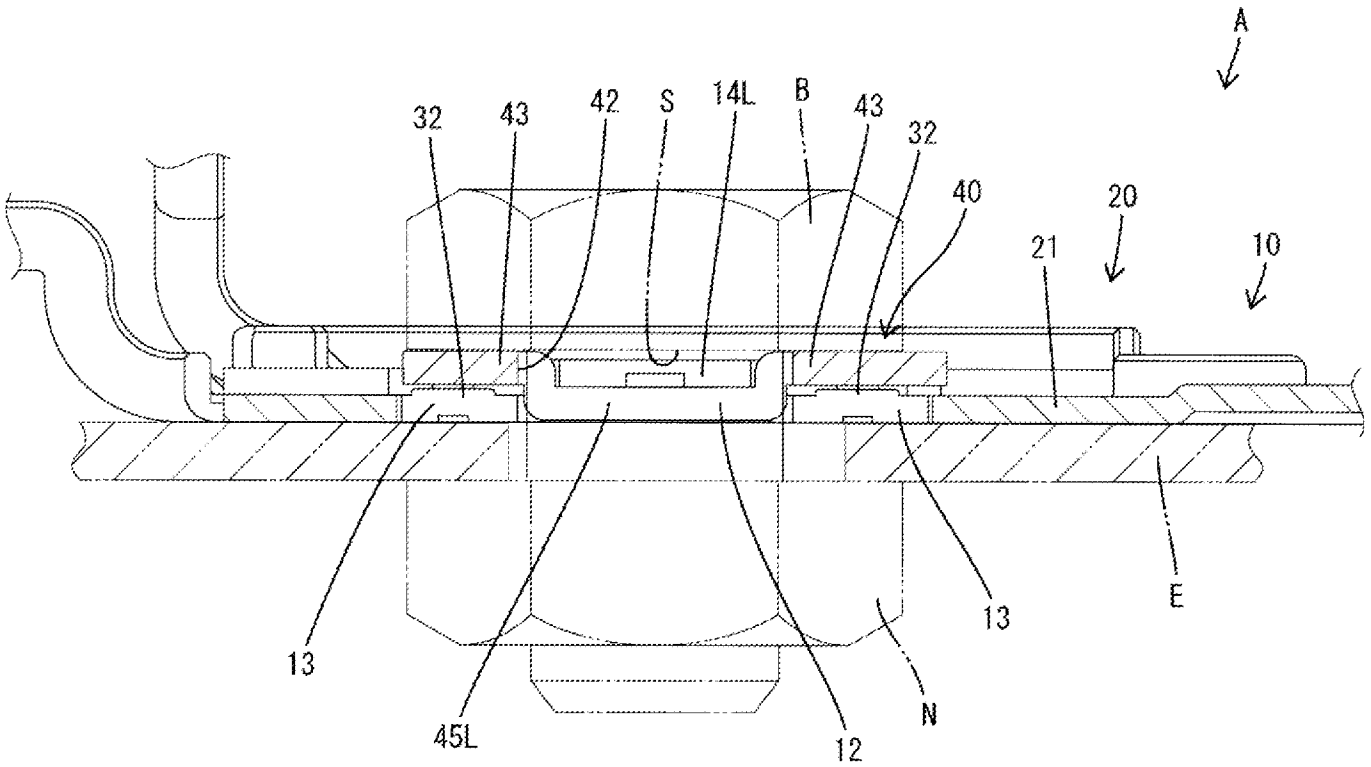
FIG. 10 is a section along Y-Y of FIG. 2.

As shown in FIG. 8, the second grounding terminal fitting 40 is composed of a single component. The second grounding terminal fitting 40 includes a second grounding connecting portion 41 substantially in the form of a flat plate as a whole and a crimping portion 47 (conductive path connecting portion as claimed) in the form of an open barrel connected to the rear end edge of the second grounding connecting portion 41. The crimping portion 47 is crimped and connected to one second conductive path Wb formed by a coated wire. A plate thickness of the second grounding connecting portion 41 is substantially equal to those of the first and second plate-like portions 21, 31 constituting the first grounding terminal fitting 10.

The second grounding connecting portion 41 is formed with a second bolt insertion hole 42 penetrating in the vertical direction (plate thickness direction). Front and rear edge sides of an opening edge part of the second bolt insertion hole 42 serve as a pair of front and rear second plate-like connecting portions 43 extending in the lateral direction. Right end parts of the lower surfaces of the both front and rear second plate-like connecting portions 43 are struck to project slightly downwardly, thereby forming second contact portions 44.

Further, left and right edge sides of the opening edge part of the second bolt insertion hole 42 serve as a pair of left and right second assembling locking portions 45L, 45R. These left and right second assembling locking portions 45L, 45R project downwardly (toward an under surface side) in a step-like manner with respect to the second plate-like connecting portions 43. That is, a projecting direction of the second assembling locking portions 45L, 45R from the second plate-like connecting portions 43 and that of the first assembling locking portions 14L, 14R from the first plate-like connecting portions 13 are vertically opposite. A height difference between these second assembling locking portions 45L, 45R and the second plate-like connecting portions 43 is a dimension slightly smaller than plate thicknesses of the second plate-like connecting portions 43 and the second assembling locking portions 45L, 45R. The right second assembling locking portion 45R is formed with a second assembling locking hole 46R penetrating in the vertical direction. The left second assembling locking portion 45L is formed with a second assembling locking projection 46L projecting obliquely upwardly to the right by cutting and bending.

<Assembled Form of First and Second Grounding Terminal Fittings 10, 40>

In assembling the first and second grounding terminal fittings 10, 40, the second grounding connecting portion 41 is placed on the first grounding connecting portion 11 and the left second assembling locking portion 45L is arranged to the right of the left first assembling locking portion 14L and accommodated into the first bolt insertion hole 12. Accordingly, the right second assembling locking portion 45R is arranged at a position displaced rightwardly from the right first assembling locking portion 14R. Further, the pair of front and rear second plate-like connecting portions 43 are displaced rightwardly from the pair of front and rear first plate-like connecting portions 13, but in the same positional relationship in the front-back direction as in a properly assembled state. That is, the second grounding terminal fitting 40 is at a position displaced rightwardly from the proper united position with respect to the first grounding terminal fitting 10.

From this state, the second grounding terminal fitting 40 is slid leftward (moved in parallel) relative to the first grounding terminal fitting 10. During this time, the left second assembling locking portion 45L slips under the left first assembling locking portion 14L and the right second assembling locking portion 45R slips under the right first assembling locking portion 14R. When the first and second grounding terminal fittings 10, 40 reach the properly assembled state, both front and rear end parts of the left second assembling locking portion 45L come into contact with both front and rear end parts of the left first assembling locking portion 14L from the right and both front and rear end parts of the right second assembling locking portion 45R come into contact with both front and rear end parts of the right first assembling locking portion 14R from the right, thereby regulating a relative leftward movement (slide) of the second grounding terminal fitting 40.

Simultaneously, the second assembling locking projection 46L is locked into the first assembling locking hole 15L and the second assembling locking hole 46R is locked to the first assembling locking projection 15R, thereby regulating a rightward returning movement of the second grounding terminal fitting 40 with respect to the first grounding terminal fitting 10. Further, the second contact portions 44 on the lower surface of the second grounding connecting portion 41 come into contact with the upper surface of the first grounding connecting portion 11 and the first contact portions 14 on the upper surface of the first grounding connecting portion 11 come into contact with the lower surface of the second grounding connecting portion 41, thereby regulating a relative downward movement of the second grounding terminal fitting 40 with respect to the first grounding terminal fitting 10. Further, the second assembling locking portions 45L, 45R come into contact with the lower surfaces of the first assembling locking portions 14L, 14R, thereby regulating an upward relative movement (separation) of the second grounding terminal fitting 40 with respect to the first grounding terminal fitting 10. In the above way, the first and second grounding terminal fittings 10, 40 are assembled to configure the grounding terminal unit A.

With the first and second grounding terminal fittings 10, 40 assembled, the first bolt insertion hole 12 located on the lower side and the second bolt insertion hole 42 located on the upper side are substantially concentrically aligned. Further, the pair of front and rear first plate-like connecting portions 13 and the pair of front and rear second plate-like connecting portions 43 are vertically placed one over the other and the pair of left and right first assembling locking portions 14L, 14R and the pair of left and right second assembling locking portions 45L, 45R are vertically placed one over the other on the opening edge parts of the both bolt insertion holes 12, 42. In the vertical direction, the upper surfaces of the first assembling locking portions 14L, 14R are arranged at a position slightly lower than the upper surfaces of the second plate-like connecting portions 43 and the lower surfaces of the first plate-like connecting portions 13 are arranged at a position slightly higher than the lower surfaces of the second assembling locking portions 45L, 45R. Thus, a plate thickness of the grounding terminal unit A at the opening edge parts of the both bolt insertion holes 12, 42 is the sum of the plate thickness of the first plate-like connecting portions 13 and that of the second plate-like connecting portions 43.

<Functions and Effects of First Embodiment>

In connecting the grounding terminal unit A configured as described above to the grounding part E, the grounding terminal unit A is placed on the upper surface of the grounding part E and the both bolt insertion holes 12, 42 are aligned with a nut N of the grounding part E. In this state, the bolt B is inserted into the bolt insertion holes 12, 42 from above the grounding terminal unit A and screwed into the nut N. When the bolt B is tightened, a seating surface S of a head part of the bolt B comes into contact with the upper surfaces of the second plate-like connecting portions 43 and the plate-like connecting portions 13, 43 are sandwiched in the plate thickness direction between the seating surface S and the grounding part E. In the above way, the grounding terminal unit A is grounded to the grounding part E at the plate-like connecting portions 13, 43.

The grounding terminal unit A of this embodiment is configured by assembling the first and second grounding terminal fittings 10, 40. The first grounding terminal fitting 10 is formed with the first bolt insertion hole 12, the first plate-like connecting portions 13 arranged at the opening edge of the first bolt insertion hole 12 and the first assembling locking portions 14L, 14R. The grounding terminal fitting 40 is formed with the second bolt insertion hole 42, the second plate-like connecting portions 43 arranged at the opening edge of the second bolt insertion hole 42 and the second assembling locking portions 45L, 45R. The two grounding terminal fittings 10, 40 are held in such an assembled state that the first and second plate-like connecting portions 13, 43 are placed one over the other in the plate thickness direction by the locking of the first assembling locking portions 14L, 14R and the second assembling locking portions 45L, 45R. The assembled two grounding terminal fittings 10, 40 are connected to the grounding part E in a state where the bolt B constituting the fastening member is penetrated through the first and second bolt insertion holes 12, 42 and the first and second plate-like connecting portions 13, 43 are sandwiched between the seating surface S of the fastening member and the grounding part E.

In the grounding terminal unit A of this embodiment, the first grounding terminal fitting 10 is configured by uniting the two divided fittings 20, 30 including the plurality of tabs 19 connectable to the female terminal fittings T of the first conductive path Wa. Thus, the number of the first conductive paths Wa (grounding conductive paths) connectable to the grounding terminal unit A of this embodiment and the number of types thereof can be increased as compared to the case where the first grounding terminal fitting is composed of a single component.

Further, the two divided fittings 20, 30 are formed with the uniting locking portions 35, 33 for holding the two divided fittings 20, 30 in the united state by locking to each other at the position different from the first plate-like connecting portions 13. The uniting locking portions 25, 33 arranged at the position different from the first plate-like connecting portions 13 do not interfere with the seating surface S of the bolt B and the grounding part E. By arranging the uniting locking portions 25, 33 at the position different from the first plate-like connecting portions 13, the first plate-like connecting portions 13 are in the form of single plates.

According to this configuration, the thickness of the first plate-like connecting portions 13 is maintained at the same dimension as in the case where the first grounding terminal fitting is composed of a single component. Thus, according to this embodiment, even if the number of constituent components of the first grounding terminal fitting 10 is increased to two, it is not necessary to change the interval between the grounding part E and the seating surface S of the fastening member. As just described, according to this embodiment, the number of the connectable first conductive paths Wa (grounding conductive paths) and the number of types thereof can be increased without increasing the number of types of the fastening members (bolts B) used.

Further, in the grounding terminal unit A of this embodiment, both of the two divided fittings 20, 30 are formed with the first plate-like connecting portions 13. According to this configuration, since both of the two divided fittings 20, 30 are reliably sandwiched between the seating surface S of the fastening member and the grounding part E at the first plate-like connecting portions 13, connection reliability to the grounding part E is high. Further, out of the two divided fittings 20, 30, the first divided fitting 20 is formed with the frame portion 23 continuously surrounding the first bolt insertion hole 12 over the entire circumference and parts of the inner peripheral edge of the frame portion 23 serve as the protruding portions 24 constituting parts of the first plate-like connecting portions 13. By this configuration, the strength of the first plate-like connecting portions 13 is enhanced by the frame portion 23.

Further, the locking strength of the first and second uniting locking portions 25, 33 as a means for holding the first and second divided fittings 20, 30 in the united state is set to be higher than that of the first assembling locking portions 14L, 14R and the second assembling locking portions 45L, 45R as a means for holding the first and second grounding terminal fittings 10, 40 in the assembled state. According to this setting, the locking of the first and second uniting locking portions 25, 33 is not released in a step of assembling the first and second grounding terminal fittings 10, 40, wherefore it is not necessary to separate the first and second divided fittings 20, 30.

Further, as shown in FIG. 2, a contact part of the crimping portion 47 of the second grounding terminal fitting 40 with the second conductive path Wb is entirely surrounded by a waterproofing material 48 such as silicon resin. Thus, even if water adheres to the second grounding terminal fitting 40, the intrusion of that water into the inside of a core of the second conductive path Wb and to a side opposite to the grounding terminal unit A through a clearance between the core and an insulation coating is prevented.

Further, the two divided fittings 20, 30 are formed with the plate-like portions 21, 31 constituting the first grounding connecting portion 11, the plurality of arm portions 17 extending substantially at a right angle from the plate-like portions 21, 31, the plurality of plate-like supporting portions 18 extending substantially at a right angle from the extending ends of the arm portions 17 and the plurality of long and narrow tabs 19 projecting in parallel in a cantilever manner from the extending end edges of the plurality of plate-like supporting portions 18, and the harness connecting portion 16 to be connected to the plurality of first conductive paths Wa constituting the wiring harness is configured by the plurality of arm portions 17, the plurality of plate-like supporting portions 18 and the plurality of tabs 19. According to this configuration, the plurality of plate-like supporting portions 18 are provided and the plurality of long and narrow tabs 19 project in parallel in a cantilever manner from the extending end edges of the respective plate-like supporting portions 18, whereby it could be realized to configure the harness connecting portion 16 connectable to the plurality of first conductive paths Wa.

Further, since at least the first divided fitting 20 (one divided fitting), out of the two divided fittings 20, 30, is formed with the plurality of tabs 19, the number of the connectable first conductive paths Wa can be increased. Further, since the conductive path connecting portion to be connected to the second conductive path Wb is formed as the crimping portion 47 in the form of an open barrel, the second conductive path Wb can be reliably connected to the second grounding terminal fitting 40 by the crimping portion 47. Further, the conductive path connecting portions (tabs 19) of the first grounding terminal fitting 10 and the conductive path connecting portion (crimping portion 47) of the second grounding terminal fitting 40 have mutually different connection forms. According to this configuration, a plurality of types of grounding conductive paths (first conductive paths Wa and second conductive path Wb) having different connection forms can be connected.

Second Embodiment

Figure 11:
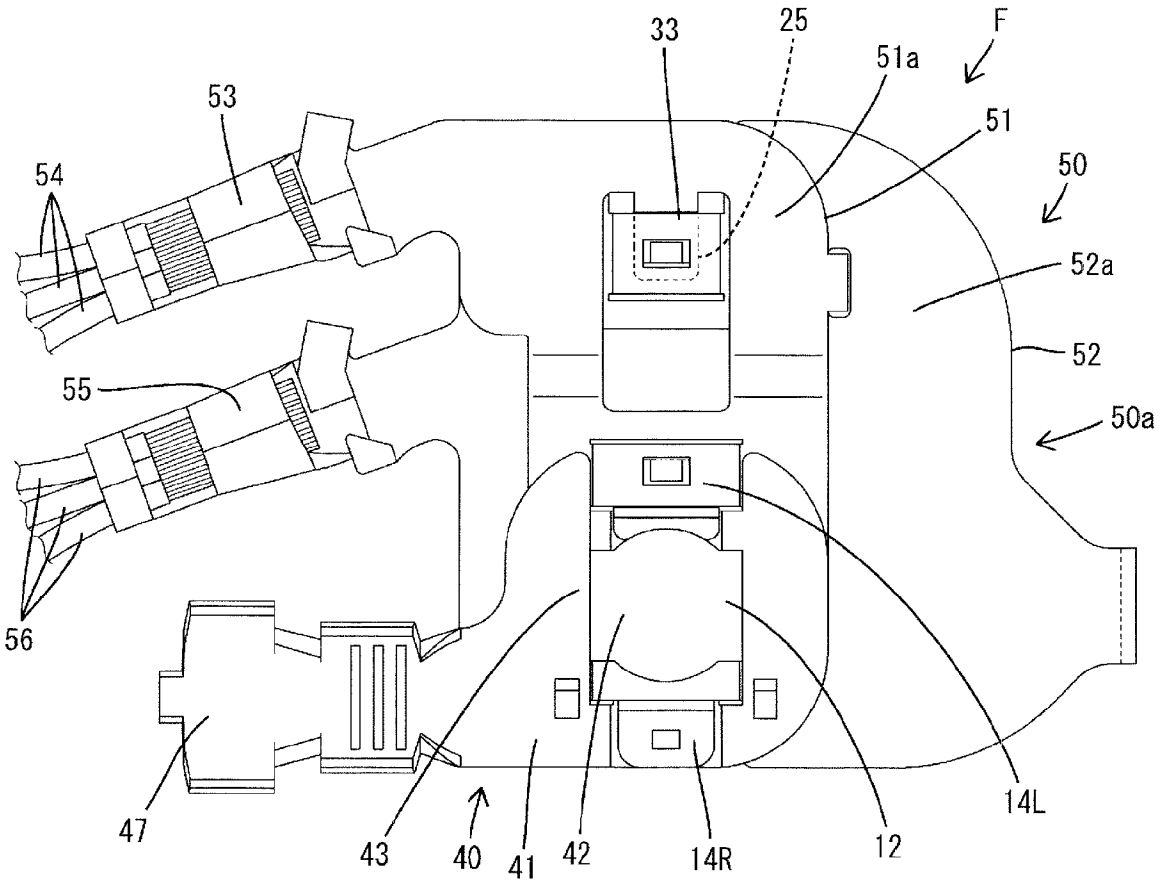
FIG. 11 is a plan view of a grounding terminal unit of a second embodiment.

Next, a second specific embodiment of the present invention is described with reference to FIG. 11. In a grounding terminal unit F of this second embodiment, conductive path connecting portions of a first grounding terminal fitting 50 as a connection means to first conductive paths 54, 56 are different in form from the tabs 19 of the first grounding terminal fitting 10. Since the other configuration is the same as in the above first embodiment, the same components are denoted by the same reference signs and the structures, functions and effects thereof are not described.

The first grounding terminal fitting 50 is formed such that two left and right crimping portions 53, 55 (conductive path connecting portions as claimed) in the form of open barrels extend backward in a cantilever manner from a first grounding connecting portion 50*a*, and configured by uniting a first divided fitting 51 and a second divided fitting 52. The first divided fitting 51 is formed such that one crimping portion 53 extends from a first plate-like portion 51*a* including parts of first plate-like connecting portions (not shown) of the same form as in the first embodiment. The second divided fitting 52 is formed such that the other crimping portion 55 extends from a second plate-like portion 52*a* including parts of the first plate-like connecting portions. The first and second plate-like portions 51*a*, 52*a* constitute the first grounding connecting portion 50*a* in a state where the both divided fittings 51, 52 are united.

The first conductive paths 54 (grounding conductive paths as claimed), which are a plurality of bundled coated wires including cores made of copper or copper alloy, are collectively connected to the crimping portion 53 of the first divided fitting 51 by crimping. The second conductive paths 56, which are a plurality of bundled coated wires including cores made of aluminum or aluminum alloy, are collectively connected to the crimping portion 55 of the second divided fitting 52 by crimping. Note that the materials of the cores of the coated wires connected to the crimping portions 53, 55 and the numbers of the coated wires connected to the crimping portions 53, 55 can be appropriately changed. Further, a waterproofing means using the waterproofing material 48 as in the first embodiment can be applied to the crimping portions 53, 55.

The first and second divided fittings 51, 52 are respectively formed with a first uniting locking portion 25 and a second uniting locking portion 33 having the same locking structure as in the first embodiment. However, a uniting direction of the uniting locking portions 25, 33 of this second embodiment is not the front-back direction, but the width direction (lateral direction), i.e. a direction parallel to an assembling direction of the first and second grounding terminal fittings 50, 40. Since the locking strength of the uniting locking portions 25, 33 is set to be higher than that of the assembling locking portions 13, 43 in this second embodiment, there is no possibility that the locking of the uniting locking portions 25, 33 is released and the divided fittings 51, 52 are separated from each other in assembling the grounding terminal fittings 40, 50 with each other.

With the two divided fittings 51, 52 united to configure the first grounding terminal fitting 50, the plate-like portions 51*a*, 52*a* are arranged in the width direction, whereby the first grounding connecting portion 50*a* including the first plate-like connecting portions is configured. The second grounding terminal fitting 40 is formed such that a crimping portion 47 extends backward in a cantilever manner from a second grounding connecting portion 41 including second plate-like portions 43. The first grounding connecting portion 50*a* and the second grounding connecting portion 41 are assembled to be arranged in the width direction (direction parallel to an arrangement direction of the first plate-like portion 51*a* of the first divided fitting 51 and the second plate-like portion 52*a* of the second divided fitting 52). The crimping portions 53, 55 of the first grounding terminal fitting 50 and the crimping portion 47 of the second grounding terminal fitting 40 extend in a direction intersecting with the width direction (backward). According to this configuration, all of the plurality of crimping portions 47, 53 and 55 formed on the first and second grounding terminal fittings 50, 40 are arranged within a range taken up by the first and second grounding connecting portions 50*a*, 41 in the width direction. Thus, enlargement in the width direction can be avoided.

Further, since the three crimping portions 47, 53 and 55 are arranged in parallel in the width direction, the coated wires 54, 56 connected to these crimping portions 47, 53 and 55 by crimping also extend backward while being arranged side by side in the width direction. In this second embodiment, an outer diameter of the bundle of the coated wires 56 connected to the crimping portion 55 arranged in a widthwise center is larger than that of the bundle of the coated wires 54 connected to the crimping portion 53 arranged on a widthwise left side and that of the coated wire connected to the crimping portion 47 arranged on a widthwise right side. Thus, a bundle of a wiring harness is stable in shape when these coated wires 54, 56 are collectively taped.

Third Embodiment

Figure 12:
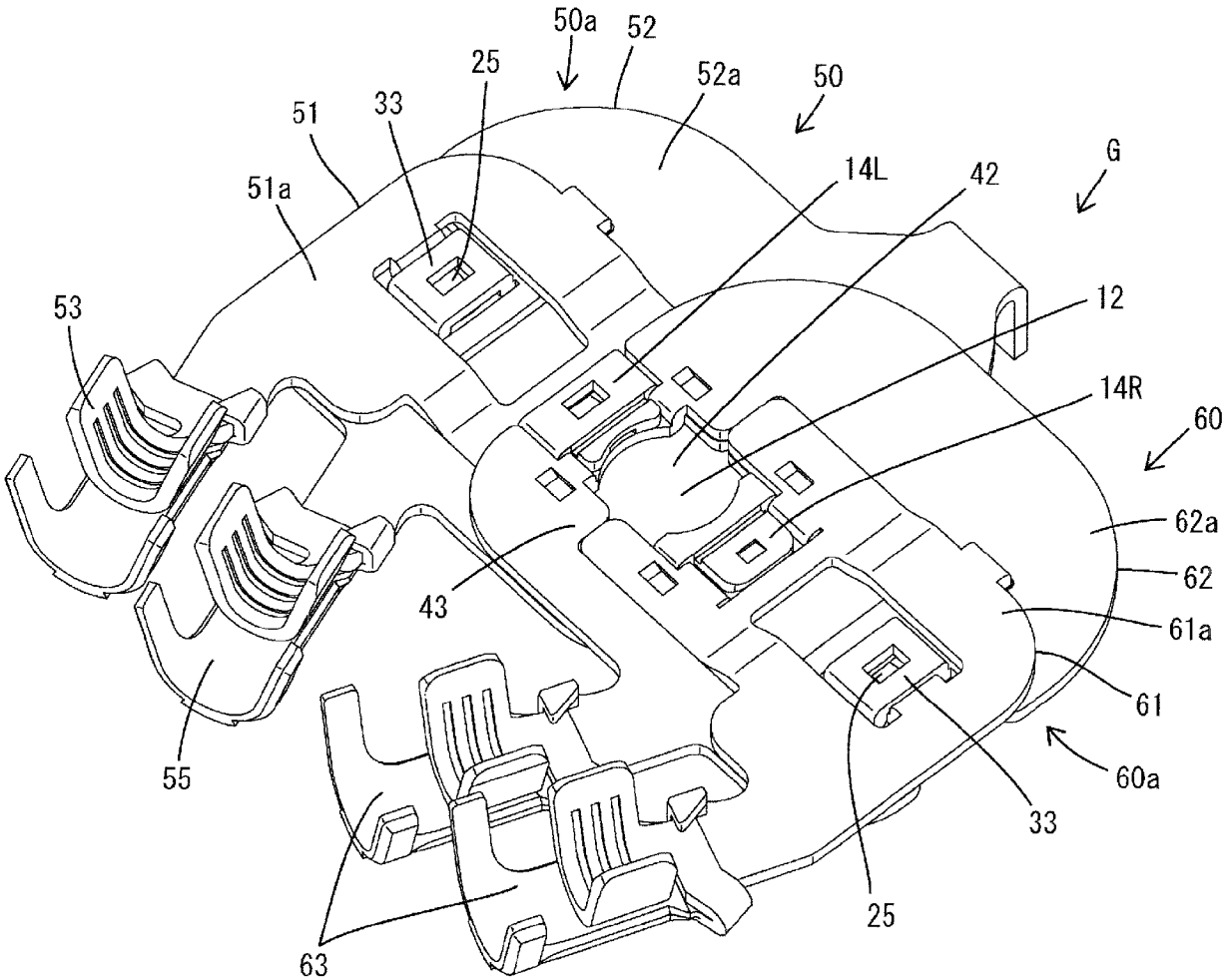
FIG. 12 is a perspective view of a grounding terminal unit of a third embodiment.

Next, a third specific embodiment of the present invention is described with reference to FIG. 12. In a grounding terminal unit G of this third embodiment, a second grounding terminal fitting 60 is configured differently from the second grounding terminal fitting 40 of the above second embodiment. Since the other configuration is the same as in the above first embodiment, the same components are denoted by the same reference signs and the structures, functions and effects thereof are not described.

The second grounding terminal fitting 60 of this third embodiment is formed such that two left and right crimping portions 63 (conductive path connecting portions as claimed) in the form of open barrels extend backward in a cantilever manner from a second grounding connecting portion 60*a* similarly to the first grounding terminal fitting 50 of the second embodiment and configured by uniting a first divided fitting 61 and a second divided fitting 62. The first divided fitting 61 is formed such that one crimping portion 63 extends from a first plate-like portion 61*a* including parts of second plate-like connecting portions 43 of the same shape as in the first embodiment. The second divided fitting 62 is formed such that the other crimping portion 65 extends from a second plate-like portion 62*a* including parts of the second plate-like connecting portions 43. The first and second plate-like portions 61*a*, 62*a* constitute the second grounding connecting portion 60*a* in a state where the both divided fittings 61, 62 are united.

A uniting structure of the first and second divided fittings 61, 62 constituting the second grounding terminal fitting 60 is the same as that of the first and second divided fittings 51, 52 in the first grounding terminal fitting 50 of the second embodiment. Further, an assembling structure of the second grounding terminal fitting 60 with the first grounding terminal fitting 50 is composed of a pair of left and right second assembling locking portions 14L, 14R as in the second embodiment. The materials of cores of coated wires (not shown) to be connected to each crimping portion 63 by crimping and the number of the coated wires (not shown) to be connected to each crimping portion 63 by crimping can be appropriately set and changed. Further, a waterproofing means using the waterproofing material 48 as in the first and second embodiment can be applied to the crimping portions 63.

The first and second divided fittings 61, 62 of the second grounding terminal fitting 60 are respectively formed with a first uniting locking portion 25 and a second uniting locking portion 33 having the same locking structure as in the first and second embodiments. However, a uniting direction of the uniting locking portions 25, 33 of this third embodiment is not the front-back direction, but the width direction (lateral direction), i.e. a direction parallel to a uniting direction of the first and second divided fittings 51, 52 of the first grounding terminal fitting 50 and an assembling direction of the first and second grounding terminal fittings 50, 60. Since the locking strength of the uniting locking portions 25, 33 is set to be higher than that of assembling locking portions 13, 43 in this third embodiment, there is no possibility that the locking of the uniting locking portions 25, 33 is released, the divided fittings 51, 52 are separated from each other and the divided fittings 61, 62 are separated from each other in assembling the grounding terminal fittings 50, 60 with each other.

With the two divided fittings 51, 52 united to configure the first grounding terminal fitting 50, the plate-like portions 51*a*, 52*a* are arranged in the width direction, whereby the first grounding connecting portion 50*a* including the first plate-like connecting portions is configured. Further, with the two divided fittings 61, 62 united to configure the second grounding terminal fitting 60, the plate-like portions 61*a*, 62*a* are arranged in the width direction, whereby the second grounding connecting portion 60*a* including the second plate-like connecting portions 43 is configured. The first and second grounding connecting portions 50*a*, 60*a* are assembled to be arranged in the width direction.

Two crimping portions 53, 55 of the first grounding terminal fitting 50 and the two crimping portions 63 of the second grounding terminal fitting 60 extend in a direction intersecting with the width direction (backward). According to this configuration, all of the plurality of crimping portions 53, 55 and 63 formed on the first and second grounding terminal fittings 50, 60 are arranged within a range taken up by the first and second grounding connecting portions 50*a*, 60*a* in the width direction. Thus, enlargement in the width direction can be avoided.

Further, since the four crimping portions 53, 55 and 63 are arranged in parallel in the width direction, coated wires connected to these crimping portions 53, 55 and 63 by crimping also extend backward while being arranged side by side in the width direction. In this third embodiment, outer diameters of bundles of the coated wires connected to two crimping portions 55, 63 arranged in a widthwise center are larger than that of a bundle of the coated wires connected to the crimping portion 53 arranged on a widthwise left side and that of a bundle of the coated wires connected to the crimping portion 63 arranged on a widthwise right side. Thus, a bundle of a wiring harness is stable in shape when these coated wires are collectively taped.

The invention is not limited to the above described and illustrated embodiments. For example, the following embodiments also are included in the scope of the invention.

Although both of the two divided fittings are each formed with one first assembling locking portion in the above first to third embodiments, either one of the two divided fittings may be formed with a pair of first assembling locking portions and the other divided fitting may not be formed with any first assembling locking portion.

In the above first to third embodiments, the first and second assembling locking portions may be sandwiched between the seating surface of the fastening member and the grounding part.

Although both of the two divided fittings are formed with the first plate-like connecting portions in the first to third embodiments, only either one of the divided fittings may be formed with the first plate-like connecting portions and the other divided fitting may not be formed with any first plate-like connecting portion.

Although the two divided fittings are respectively formed with the plurality of conductive path connecting portions in the above first embodiment, at least one divided fitting may be formed with only one conductive path connecting portion.

Although the conductive path connecting portions of the divided fittings are in form of tabs to be mated with the female conductive paths in the above first embodiment, the conductive path connecting portions of the divided fittings may be in the form of rectangular tubes to be mated with male (tab-shaped) conductive paths.

Although the conductive path connecting portions of the divided fittings are connected to the conductive paths by easily separable mating connection in the above first embodiment, the conductive path connecting portions of the divided fittings may be so connected to the conductive paths as not to be easily separable such as by welding and crimping.

Although one divided fitting is formed with the frame portion surrounding the first bolt insertion hole and only parts of the first plate-like connecting portions are formed on the inner peripheral edge of the frame portion in the above first to third embodiments, the entire areas of the first plate-like connecting portions may be formed on the inner peripheral edge of the frame portion.

Although the second grounding terminal fitting is composed of a single member in the first embodiment, it may be configured by assembling a plurality of divided fittings.

Although the conductive path connecting portion of the second grounding terminal fitting is connected to the conductive path by crimping in the above first to third embodiments, it may be connected to the conductive path by another means such as mating connection or welding without limitation to crimping.

Although the second grounding terminal fitting has one conductive path connecting portion in the above first embodiment, it may be formed with a plurality of conductive path connecting portions.

Although the conductive path connecting portion of the second grounding terminal fitting is of a crimp type in the above first embodiment, it may be in the form of a tab as in the first grounding terminal fitting or may be connected by crimping, welding or the like.

In the above second and third embodiments, the crimp-type conductive path connecting portions of the first grounding terminal fitting may be in the form of tabs as in the first embodiment or may be connected by welding or the like. In the case of adopting a tab form, one or more tabs may be provided.

In the above second and third embodiments, the crimp-type conductive path connecting portion of the second grounding terminal fitting may be in the form of a tab as in the first embodiment or may be connected by welding or the like. In the case of adopting a tab form, one or more tabs may be provided.

Although all of the conductive path connecting portions of the first grounding terminal fitting and the conductive path connecting portion(s) of the second grounding terminal fitting have the same connection form (crimp type) in the above second and third embodiments, a combination of mutually different connection forms (e.g. a combination of the tab form and the crimp type, a combination of the tab form and welding, a combination of the crimp type and welding, etc.) may be adopted for the conductive path connecting portions of the first grounding terminal fitting and the conductive path connecting portion(s) of the second grounding terminal fitting.

Although the conductive path connecting portions of the two divided fittings constituting the first grounding terminal fitting have the same connection form (tab form or crimp type) in the above first to third embodiments, a combination of mutually different connection forms (e.g. a combination of the tab form and the crimp type, a combination of the tab form and welding, a combination of crimping and welding, etc.) may be adopted for the conductive path connecting portions of the two divided fittings constituting the first grounding terminal fitting.

Although the conductive path connecting portions of the two divided fittings constituting the second grounding terminal fitting have the same connection form (crimp type) in the above third embodiment, a combination of mutually different connection forms (e.g. a combination of the tab form and the crimp type, a combination of the tab form and welding, a combination of crimping and welding, etc.) may be adopted for the conductive path connecting portions of the two divided fittings constituting the second grounding terminal fitting.

Although all the three conductive path connecting portions have the same connection form (crimping) in the second embodiment, a combination of mutually different connection forms (e.g. a combination of the tab form, crimping and welding) may be adopted for all the three conductive path connecting portions or two out of the three conductive path connecting portions may have the same connection form.

Although all the four conductive path connecting portions have the same connection form (crimping) in the third embodiment, a combination of mutually different connection forms (e.g. a combination of the tab form, crimping, welding and the other) may be adopted for all the four conductive path connecting portions, three out of the four conductive path connecting portions may have the same connection form, two out of the four conductive path connecting portions may have the same connection form and the remaining two conductive path connecting portions may also have the same connection form or only three of the four conductive path connecting portions may have mutually different connection forms.

Although the bolt inserted into the bolt insertion holes is screwed into the grounding part to sandwich the grounding terminal unit between the seating surface of the head part of the bolt and the grounding part in the above first to third embodiments, a stud bolt as a fastening member standing on the grounding part may be penetrated through the bolt holes and the grounding terminal unit may be sandwiched between a seating surface of a nut screwed onto the stud bolt and the grounding part.

Although all the conductive path connecting portions extend backward in the above first to third embodiments, some of the conductive path connecting portions may extend forward or laterally (left or right). That is, a plurality of conductive path connecting portions provided on one grounding terminal fitting may extend in mutually different directions.

Although four plate-like supporting portions are provided in the above first embodiment, the number of the plate-like supporting portions may be three or less or five or more.

LIST OF REFERENCE SIGNS

A . . . grounding terminal unit
B . . . bolt (fastening member)
E . . . grounding part
S . . . seating surface
Wa . . . first conductive path (grounding conductive path)
Wb . . . second conductive path (grounding conductive path)
10 . . . first grounding terminal fitting
12 . . . first bolt insertion hole
13 . . . first plate-like connecting portion
14L, 14R . . . first assembling locking portion
16 . . . harness connecting portion
17 . . . arm portion
18 . . . plate-like supporting portion
19 . . . tab (conductive path connecting portion)
20 . . . first divided fitting
21 . . . first plate-like portion (plate-like portion)
23 . . . frame portion
25 . . . first uniting locking portion
30 . . . second divided fitting
31 . . . second plate-like portion
33 . . . second uniting locking portion
40 . . . second grounding terminal fitting
42 . . . second bolt insertion hole
43 . . . second plate-like connecting portion
45L, 45R . . . second assembling locking portion
47 . . . crimping portion (conductive path connecting portion)
F, G . . . grounding terminal unit
50 . . . first grounding terminal fitting
53, 55 . . . crimping portion (conductive path connecting portion)
54, 56 . . . first conductive path (grounding conductive path)
60 . . . second grounding terminal fitting
63 . . . crimping portion (conductive path connecting portion)

The invention claimed is:

1. A grounding terminal unit, comprising:

a first grounding terminal fitting comprising:

a first divided fitting having a first plate-like portion with an opening penetrating therethrough, and a first uniting locking portion and a right first assembling locking portion formed on the first plate-like portion;

a second divided fitting having a second plate-like portion, a second uniting locking portion and a left first assembling locking portion, wherein the first divided fitting is fitted on the second divided fitting with the first uniting locking portion engaging the second locking portion, the left first assembling locking portion engaging the right first assembling locking portion to define a first assembling locking portion, the opening defining first bolt insertion hole and areas of the first plate-like portion and the second plate-like portion on an opening edge of the first bolt insertion hole engage each other to define a first connecting plate; and a second grounding terminal fitting formed with a second bolt insertion hole, a second connecting plate arranged on an opening edge of the second bolt insertion hole and a second assembling locking portion;

wherein:

the first and second connecting plates are held in an assembled state where the first and second connecting plates are placed one over the other in a plate thickness direction by locking of the first and second assembling locking portions;

a fastening member is penetrated through the first and second bolt insertion holes and connected to a grounding part with the first and second connecting plates sandwiched between a seating surface of the fastening member and the grounding part;

the first and second divided fittings include conductive path connecting portions connectable to grounding conductive paths; and the first connecting plate is in the form of a single plate in a state where the first and second divided fittings are united.

2. The grounding terminal unit of claim 1, wherein one of the first and second divided fittings is formed with a frame continuously surrounding the first bolt insertion hole and an inner peripheral edge of the frame defines at least a part of the first connecting plate.

3. The grounding terminal unit of claim 1, wherein:

the first and second divided fittings are formed such that a conductive path connecting portion extends from the first and second plate-like portions;

the first and second plate-like portions are arranged in a width direction with the first and second divided fittings united to configure the first grounding terminal fitting including the first connecting plate;

the second grounding terminal fitting is formed such that the conductive path connecting portion extends from a second grounding connecting portion including the second connecting plate;

the first and second grounding terminal fittings are assembled so that the first and second grounding connecting portions are arranged in the width direction; and the conductive path connecting portions of the first and second grounding terminal fittings extend in a direction intersecting the width direction.

4. The grounding terminal unit of claim 1, wherein:

the first and second divided fittings are each formed with:

a plurality of arms extending substantially at a right angle from each of the first and second plate-like portions;

a plurality of supporting plates extending substantially at a right angle from extending ends of the arms; and the plurality of the conductive path connecting portions being long and narrow and being cantilevered substantially in parallel to one another from extending ends of the supporting plates; and a harness connecting portion to be connected to a plurality of the grounding conductive paths is configured by the arms, the supporting plates and the conductive path connecting portions.

5. The grounding terminal unit of claim 1, wherein at least one of the first and second divided fittings is formed with a plurality of the conductive path connecting portions.

6. The grounding terminal unit of claim 1, wherein:

the conductive path connecting portions are crimping portions in the form of open barrels.

7. The grounding terminal unit of claim 1, wherein the conductive paths connecting portions of the first and second grounding terminal fittings have mutually different connection forms.

* * * * *